US005090782A

United States Patent [19]

Glachet et al.

[11] Patent Number: 5,090,782

[45] Date of Patent: Feb. 25, 1992

[54] DEVICE FOR THE SEALED FIXING OF AN INTERCHANGEABLE MEMBER IN A CELL FLANGE

[75] Inventors: Charles Glachet; Liliane Ponchet, both of Vendome, France

[73] Assignee: Euritech, Vendome, France

[21] Appl. No.: 578,631

[22] Filed: Sep. 7, 1990

[30] Foreign Application Priority Data

Sep. 15, 1989 [FR] France ..... 89 12102

[51] Int. Cl.[5] ..... A61G 11/00

[52] U.S. Cl. ..... 312/1

[58] Field of Search ..... 312/1,3; 52/398

[56] References Cited

U.S. PATENT DOCUMENTS 4,010,588 3/1977 Eisert ..... 312/1

4,141,609 2/1979 Eisert ..... 312/1

FOREIGN PATENT DOCUMENTS 1500680 12/1968 Fed. Rep. of Germany .

2077669 10/1972 France .

1484712 6/1987 France .

2621375 11/1987 France .

*Primary Examiner*—Joseph Falk

*Attorney, Agent, or Firm*—Oblon, Spivak, McClelland, Maier & Neustadt

[57] ABSTRACT

An interchangeable member (38), such as a glove, collar or bag, is fixed in a cell flange with the aid of a supporting ring (36) formed of two sections bearing an extremity flange (50) of the member (38) and also with the aid of a safety ring (72) secured to the flange (16) and to the supporting ring (36) by two bayonet links and rotational immobilized by two blocking members (82, 78) with respect to the flange and the supporting ring. A mounting tool (100) is equipped with an indexing part (136) which makes it possible to retract the blocking members when the safety ring is mounted.

9 Claims, 5 Drawing Sheets

DEVICE FOR THE SEALED FIXING OF AN INTERCHANGEABLE MEMBER IN A CELL FLANGE

FIELD OF THE INVENTION

The invention mainly concerns a device making it possible to seal-fix an interchangeable member, such as a glove, collar or bag, into a cell flange delimiting an opening in a containment chamber.

BACKGROUND OF THE INVENTION

The document FR-A-2 621 375 describes a sealed-fixing device including a rigid supporting ring suitable for being seal-stored in the cell flange so as to instal in the latter the interchangeable member which is mounted on this supporting ring. The accidental pulling away of the supporting ring bearing the interchangeable member is prevented by a safety ring cooperating with the supporting ring and the cell flange by means of two bayonet links.

The advantage of a fixing device designed as above is that the axial force needing to be exerted on the ring bearing the interchangeable member, both so as to place it in the cell flange and drive it in, is much less than that of a fixing device in which the axial hold of the ring supporting the interchangeable member in the cell flange is fully borne by this ring. The tooling allowing for these manoeuvres may thus be relatively simple and can be controlled manually.

However, in the device described in the document FR-A-2 621 375, the supporting ring may rotate with respect to the cell flange resulting in the unlocking of either of the bayonet links and thus risk pulling away the supporting ring bearing the interchangeable member under the effect, for example, of the pressure difference normally existing between the inside and outside of the containment chamber.

In addition, it is sometimes desirable that the interchangeable member secured to the cell flange be placed in a precise angular position with respect to this cell flange, this requirement not being guaranteed in the device described in the document FR-A-2 621 375.

SUMMARY OF THE INVENTION

The specific object of the invention is to provide a device for the sealed-fixing of an interchangeable member in a cell flange, generally embodied in accordance with the instructions contained in the document FR-A-2 621 375 and in which the safety ring renders stationary the supporting ring bearing the tool allowing for the automatic mounting of such a sealed fixing device.

To this effect, the invention provides a device for the sealed fixing of an interchangeable member in a flange mounted on one wall of a containment cell, this fixing device including a supporting ring bearing the interchangeable member and a safety ring adapted in such a way as to be secured to both the flange and the supporting ring by means of two bayonet links, wherein means are provided to immobilize the safety ring rotating with respect to both the flange and the supporting ring when the safety ring is fixed by said bayonet links.

In one preferred embodiment of the invention, the means to immobilize rotation of the safety ring include at least two blocking members mounted in the safety ring and adapted to occupy one active position and one inactive position, and at least two grooves formed respectively in the flange and in the supporting ring and respectively situated opposite each of said blocking members when the safety ring is fixed by said bayonet links so that these blocking members penetrate into the grooves when they are in the active position.

Advantageously, the safety ring bears a member for controlling the blocking members and accessible from one rear face of the safety ring and which, when activated, has the effect of bringing the blocking members into the inactive position.

BRIEF DESCRIPTION OF THE DRAWINGS

There now follows a description of a preferred embodiment of the invention given by way of example being in no way restrictive with reference to the accompanying drawings in which.

DETAILED DESCRIPTION OF THE PREFERRED EMBODIMENTS

Figure 1:
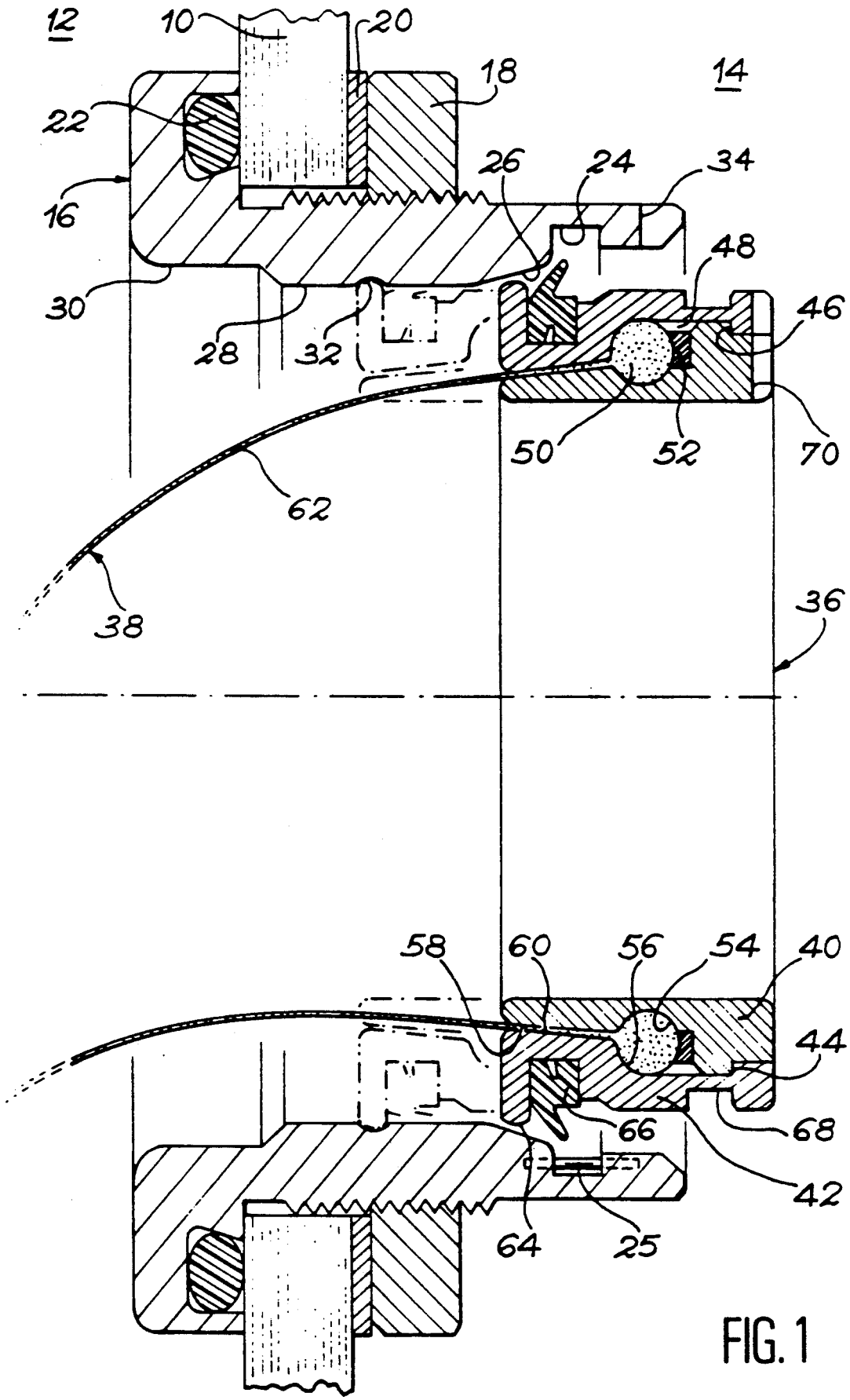
FIG. 1 is a longitudinal sectional view representing the supporting ring of a sealed fixing device conforming to the invention in the position it occupies before being introduced into a cell flange.

On FIG. 1, the reference 10 denotes one small section of the wall of a sealed containment cell serving to isolate one internal volume 12 with respect to the outer atmosphere 14. The internal volume 12 is normally a partial vacuum with respect to the outer atmosphere 14 when the cell contains substances or a dangerous atmosphere, this normally being the case in nuclear, pharmaceutical or biomedical applications. On the other hand, the internal volume 12 is in excess pressure with respect to the outer atmosphere 14 when this volume 12 needs to be protected from external contamination, this in particular being the case in medical and electronic applications.

The section of the wall 10 shown on FIG. 1 comprises a circular passage in which a cell flange 16 is seal-fixed. In the example shown, this cell flange has a collar kept in support against the internal face of the wall 10 by means of a nut 18 screwed on a threading formed on a tubular section of the flange 16 traversing the wall 10. The nut 18 is in support on the external face of the wall 10 by means of a support washer 20 and imperviousness is ensured by an O-ring seal 22 mounted in the annular throat formed on the face of the collar of the flange 16 which is in support against the internal face of the wall 10.

The internal surface of the cell flange 16 successively comprises, starting from the rear extremity of this flange turned outwardly, the female section 24 of a bayonet link system, one truncated centering section 26 whose diameter gradually reduces, one cylindrical section 28 with a relatively small diameter and a final cylindrical section 30 with a diameter larger than the section 28. A shallow or saucer-shaped throat 32 with an arc of a circle section is formed at approximately the center of the cylindrical section 28. Finally, a groove 34 orientated radially is formed on the rear face of the cell flange 16 orientated towards the outside. The female section 24 of the bayonet link system comprises a rotating stop slug 25 limiting the travel of a male section of this link.

FIG. 1 also shows a rigid supporting ring 36 constituting one section of the sealed fixing device of the invention. This supporting ring 36 carries the extremity of an interchangeable member 38, such as a glove, bag, collar, etc.

The supporting ring 36 is constituted by the assembling of two rigid parts which respectively appear in the form of an internal ring 40 and an external ring 42. If one considers that the front of the supporting ring 36 is the section of the latter to be orientated towards the inside of the cell and that the rear part is on the other hand the section of the ring to be orientated towards the outside of the cell, the relative disposition between the internal 40 and external 42 rings is such that the internal ring 40 is mounted in the external ring 42 via the rear of the latter. Fitting is ensured by clipping when a shoulder 44 orientated towards the rear and formed on the external face of the ring 40 comes to be opposite a shoulder 46 orientated towards the front and formed on the internal surface of the external ring 42.

When this fitting of the rings 40 and 42 is embodied, these rings define between them at their central section a recess 48 confining firstly a compressed toric extremity flange 50 formed at the extremity of the interchangeable member 38 and secondly a compressible annular joint 52 with, for example, a rectangular section. The dimensions of the compressible joint 52 are such that they make it possible to compensate for any possible dimensional variations of the flange 50 resulting from the manufacturing tolerances of the interchangeable member 38. Thus, by placing the compressible joint 52 behind the extremity flange 50 of the member, this ensures imperviousness of the mounting of this flange between the rings 40 and 42.

The section of the recess 48 for receiving the extremity flange 50 of the interchangeable member 38 is delimited on firstly the internal ring 40 by an arc of a circle-shaped throat 54 matching the external shape of the flange 50, and secondly on the external ring 42 by a shoulder 56 with an arc of a circle-shaped section and orientated towards the rear and also matching the outer shape of the flange 50. The result of this disposition is that when a pulling force is exerted on the member 38, a self-locking effect of the extremity flange 50 on the internal 40 and external 42 rings of the supporting ring 36 is obtained.

The outer surface of the internal ring 40 and the internal surface of the external ring 42 respectively extend towards the front beyond the throat 54 and the shoulder 56 in the form of two trucated sections 58 and 60. These truncated sections, whose diameter diminishes towards the front, delimit between them an annular space receiving the flexible wall 62 of the interchangeable member 38 ended by the extremity flange 50. The conicity of these truncated sections 58 and 60 is slightly different so that the width of said annular space is smaller close to the front face of the supporting ring 36, In this way, the flexible wall 62 is pinched at this location, which avoids dust or other substances penetrating between the rings 40 and 42.

The external ring 42 of the supporting ring 36 has a generally cylindrical external surface whose diameter is approximately equal that of the cylindrical section 28 of small diameter of the internal surface of the cell flange 16. At its front extremity, this cylindrical external surface of the ring 42 nevertheless comprises a bulged or arc of a circle-shaped annular section 64 slightly projecting with respect to the rest of the surface. This bulged annular section 64 is complementary to the throat 32 formed in the cylindrical section 28. Immediately behind the bulged annular section 64, a throat is formed on the cylindrical external surface of the ring 42 so as to house there an annular lip joint 66. Finally, the rear section of the cylindrical external surface of the ring 42 comprises the male section 68 of a bayonet link system.

A groove 70 orientated along a radial direction is formed on the rear face of the supporting ring 36, that is on both the internal ring 40 and the external ring 42.

Figure 2A:
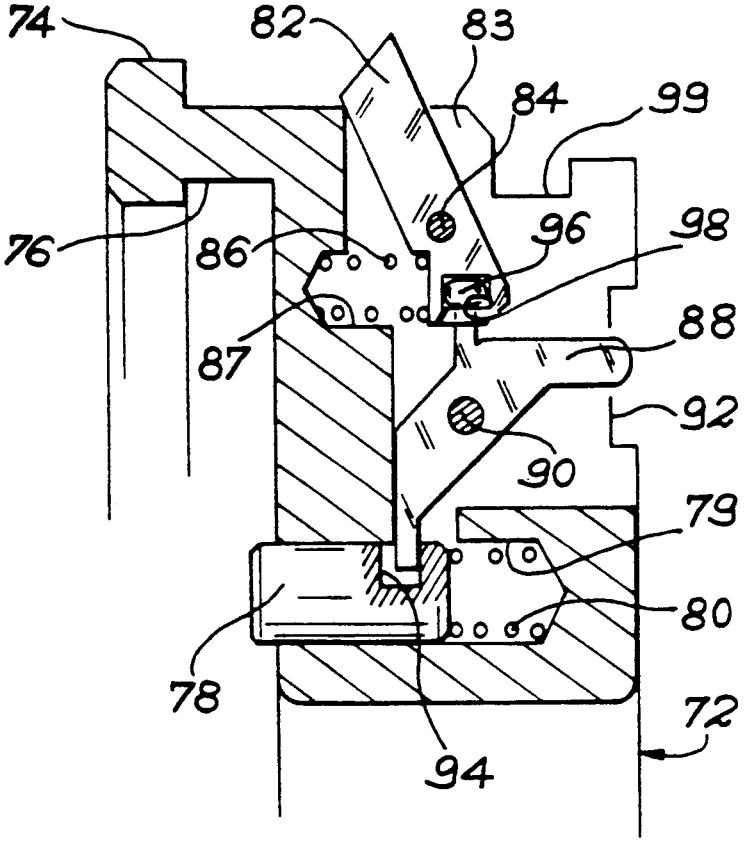
FIGS. 2A and 2B are longitudinal sectional views representing on larger scale the safety ring of the sealed fixing device of the invention when the blocking members borne by this ring are respectively in the active position and in the inactive position.
Figure 2B:
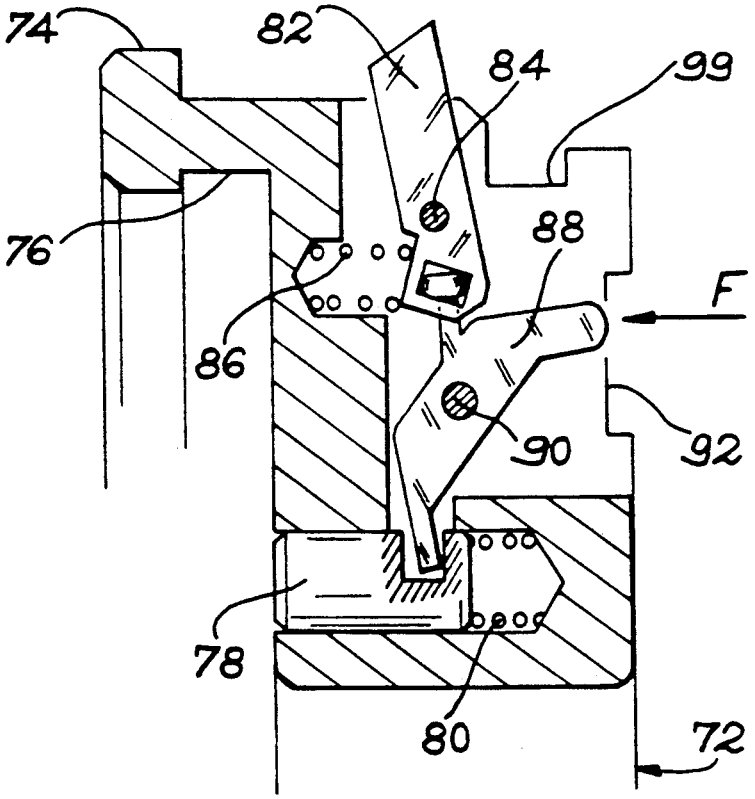

Reference is now made to FIGS. 2A and 2B showing the safety ring 72 which, along with the supporting ring 36, forms the sealed fixing device of the invention.

The safety ring 72 comprises a crown-shaped section which projects onto the external periphery of the front face of this ring and respectively has on its external and internal surfaces a male section 74 of a bayonet link system and complementary to the female section 24 formed in the cell flange 16, and a female section 76 of a bayonet link system and complementary to the male section 68 formed on the supporting ring 36. Thus, it can be clearly seen that when the supporting ring 36 has been placed inside the cell flange 16, the safety ring 72 may be respectively secured to the supporting ring 36 and to the cell flange 16 by these two bayonet link systems.

A first blocking member constituted by a sliding snug 78 is mounted in a blind hole 79 formed in the safety ring 72 so as to be able to move parallel to its axis, that is parallel to the axis of the ring 72, between an active position and an inactive position respectively illustrated on FIGS. 2A and 2B. In its active position obtained by the action of a helical compression spring 80 placed between the snug and the bottom of the blind hole 79, the sliding snug 78 projects slightly beyond the front face of the safety ring 72. On the other hand, in its inactive position, the safety snug 78 is effaced inside the ring 72 and does not go past the front face of the latter.

A second blocking member constituted by a tilting lever 82 is mounted inside a radial aperture 83 formed in the safety ring 72. This lever 82 is mounted pivoting on an axis 84 orthogonal to the axis of the ring 72 and its outer extremity projects beyond the outer surface of the ring 72 so as to be able to occupy a front active position and a rear inactive position respectively shown on FIGS. 2A and 2B. A helical compression spring 86 housed in a blind hole 87 with an axis parallel to the axis of the ring 72 takes support respectively in the bottom of this blind hole and on the extremity opposing the tilting lever 82 so as to normally keep this lever in its rear active position.

A control member, also constituted by a lever 88, is mounted pivoting in the aperture 83 around an axis 90 orthogonal to the axis of the ring 72 and parallel to the axis 84 in the example represented. The pivoting lever 88 has roughly the shape of a V articulated at its center on an axis 90 and with one first extremity normally making flush the rear face of the safety ring 72 by projecting into a recessed section 92 formed on this rear face. The extremity opposing the lever 88 penetrates into a notch 94 formed in the sliding snug 78. The lever 88 further comprises in its central section an extension 96 which penetrates an elongated slot 98 formed in the extremity of the tilting lever 82 on which the spring 86 takes support.

In the disposition just described, the sliding snug 78, the tilting lever 82 and the pivoting lever 88 constitute a kinematic assembly normally kept in the active position of the snug 78 and the lever 82 by the springs 80 and 86. In the bottom of the aperture 83, orientated towards the rear of the ring 72, the spring 80 then flattens the branch of the pivoting lever 88 which cooperates with the snug 78, whereas the spring 86 keeps the lever as a stop against the bottom of the aperture 83.

As shown on FIG. 2B, when a thrust force, symbolized by the arrow F, is applied to the first extremity of the lever 88, which normally projects into the recessed section 92, the lever 88 pivots counterclockwise around its axis 90. In carrying out this pivoting, the lever 88 moves the snug 78 towards the right against the action of the spring 80 and causes the lever 82 to pivot counterclockwise around its axis 84 against the spring 86. When the extremity of the lever 88, to which the force F is applied, trims flush the bottom of the recessed section 92, the snug 78 and the lever 82 then occupying their inactive positions shown on FIG. 2B.

So as to complete the description of the safety ring 72, FIGS. 2A and 2B show that the rear section of the external cylindrical surface of this ring comprise the male section 99 of a bayonet link system, this male section being identical to the one formed at 68 on the supporting ring 36.

Figure 3:
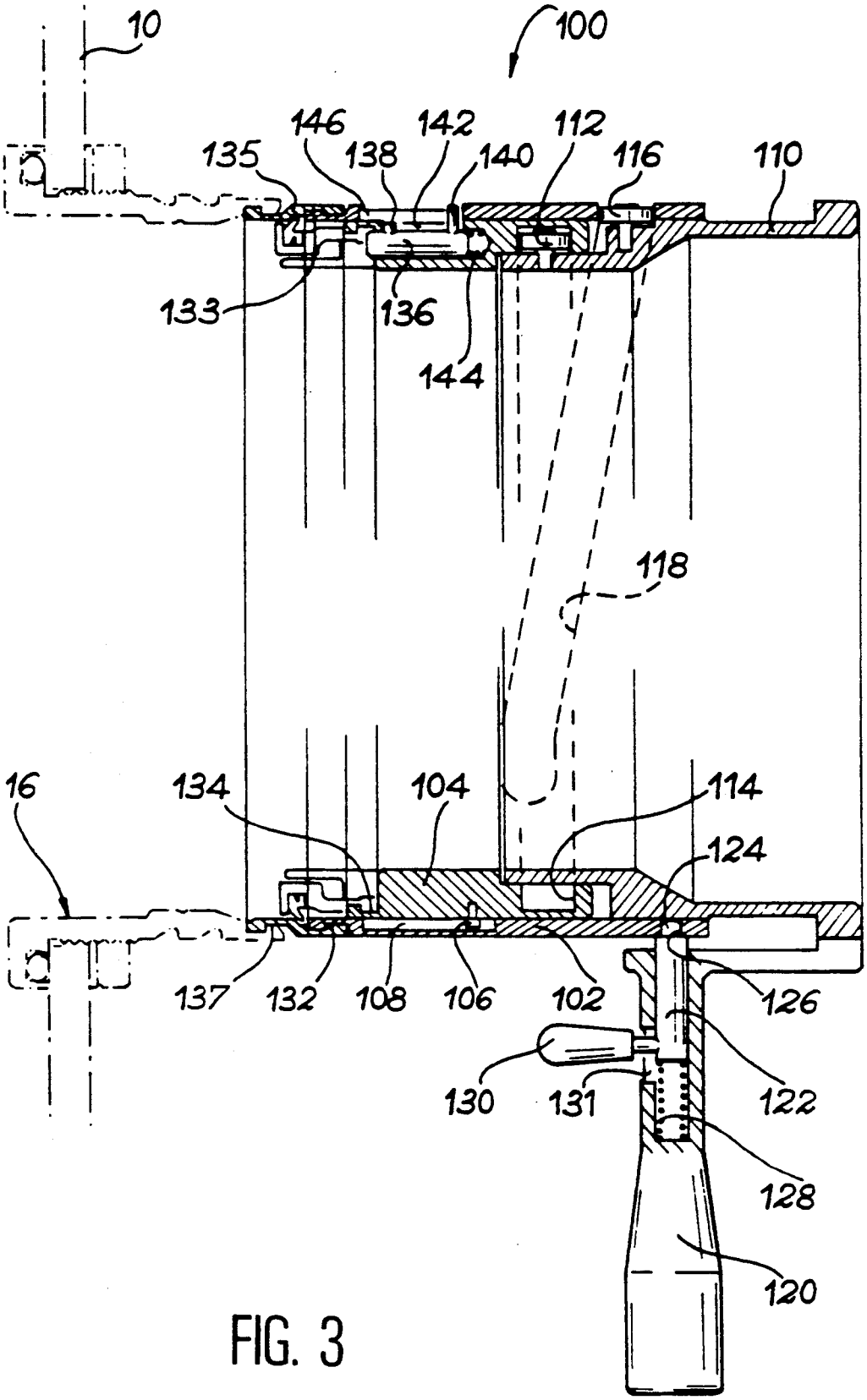
FIG. 3 is a longitudinal sectional view of the mounting tool making it possible in accordance with the invention to successively position the supporting ring and safety ring of the fixing device.

There now follows a description in detail of an assembly tool 100 particularly adapted to successive mountings of the supporting ring 36 and the safety ring 72 with reference to FIG. 3.

This tool 100 includes a sliding external sheath 102 receiving an annular piston 104. The piston 104 bears on its external surface a snug 106 which is received in a longitudinal groove 108 formed inside the sheath 102 so as to prevent any relative rotation between the piston 104 and the sheath 102.

The assembly tool 100 also includes a control sleeve 110 which penetrates into the rear sections of the sheath 102 and the piston 104. The sleeve 110 is immobilized in translation with respect to the piston 104 whilst being able to rotate freely in the latter by means of rollers 112 whose axes, orientated radially, are secured to the sleeve 110 and which are received in an annular throat 114 formed on the internal surface of the piston 104.

Furthermore, the sleeve 110 cooperates with the sheath 112 by means of a ramp system which, during a rotation of the sleeve 110 in the sheath 112, has the effect of driving a corresponding translation of this sheath with respect to the sleeve. In the example shown, this ramp system is composed of at least one roller 116 whose axis, orientated radially, is secured to the sleeve 110 and which is received in an aperture 118 formed in the sleeve 102 and approximately helix slanted.

In the structure described above, it is understood than a given rotation of the sleeve 110 with respect to the sheath 102 is expressed by a corresponding translation of the piston 104 inside the sheath 102.

It is to be noted that the assembly tool 100 generally has an annular shape whose internal diameter is roughly equal that of the ring 36. This allows for the introduction of parts unlimited in length and with a diameter corresponding to the passage diameter of the ring 36.

So as to facilitate manoeuvering of the control sleeve 110, the rear extremity of this sleeve, which projects beyond the sheath 102, bears one or several handles 120 orientated radially. At least one of these handles 120 comprises a bore receiving a cylindrical rod 122 ended by a slug 124. When the sleeve 110 occupies its extreme rear position in the sheath 102, the slug 124 is engaged in a hole 126 traversing the sheath 102 under the action of a spring 128 placed between the extremity of the rod 122 and the bottom of the bore receiving the latter, as shown on FIG. 3. A pull cord 130 secured radially to the rod 122 and projecting outside the handle 120 through an elongated hole 131 formed in the latter allows the finger 124 to be retracted so as to allow for a movement of the sleeve 110 in the sheath 102 whenever this is required.

The front extremity of the sheath 102 comprises on its outer surface a male section 132 of a bayonet link system receiving a female section 133 formed on the rear extremity of a prolonging sheath 135. The prolonging sheath 135 also comprises at its front extremity the male section 137 of a bayonet link system and complementary to the female section 24 formed in the cell ring 16. Advantageously, the male sections 132 and 137, as well the female sections 133 and 24, are identical.

The purpose of the prolonging sheath 135 is to facilitate placing of the ring 36 without possibly damaging its lip seal 66 on the piston 104. It is rotation immobilized with respect to the sheath 102 by means of a spring tongue (not shown) secured to the sheath and projecting towards the front so as to become housed in a notch of the prolonging sheath when it is mounted on the sheath.

The peripheral edge of the front face of the piston 104 is prolonged by a crown whose internal surface forms a female section 134 of a bayonet link system and complementary to the male section 68 formed on the supporting ring 36 and to the male section 99 formed on the safety ring 72.

Finally, the annular piston 104 also supports a rotating indexing part constituted by a sliding cylindrical part 136 mounted in a dummy bore formed parallel to its axis in the piston 104 and opening onto the front face of the latter. The sliding part 136 bears two radial rods 138 and 140 which are received in an elongated hole 142 formed in the piston 104 parallel to its axis and thus limit the axial clearance of the part 136 inside the latter. A compression spring 144, placed between the part 136 and the bottom of the dummy bore housing this part, normally keep this part in an active position, as shown on FIG. 3. In this position, the front extremity of the part 136 projects slightly beyond the front face of the piston 104. The cooperation of the rods 138 and 140 with the elongated hole 142 enables the part 136 to push against the spring 144 back to a rear inactive position where the front extremity of the part 136 trims the front face of the piston 104.

The radial rod 140 extends beyond the outer surface of the piston 104 into a second axial elongated hole 146 formed in the sheath 102. This elongated hole 146 is dimensioned in such a way that the radial rod 140 is close to its rear extremity when the sleeve 110 and the piston occupy their extreme rear positions, as shown on FIG. 3. On the other hand, when the sleeve 110 and the piston 104 approach their extreme front positions, the radial rod 140 comes to take support on the front extremity of the elongated hole 146, which has the effect of bringing the part 136 into its rear retracted position when the sleeve 110 and the piston 104 occupy their extreme front positions.

With reference to FIGS. 4A to 4D, there now follows a description of mounting the supporting ring 36 in the cell flange 16 by means of the tool 100.

First of all, the sleeve 110 and the piston 104 are placed in their extreme rear positions with respect to the sheath 102 to which the prolonging sheath 135 is secured. The sleeve 110 is then rendered stationary with respect to the sheath 102 by means of the slug 124, as shown on FIG. 3. In this situation, the sleeve 110, the piston 104 and the sheath 102 constitute three elements rendered stationary with respect to one another.

As the prolonging sheath 135 has not been mounted on the sheath 102, the supporting ring 36 is then secured to the front extremity of the piston 104 by the cooperation of the two sections 68 and 134 of the corresponding bayonet link. When fixing is completed, the front extremity of the indexing part 136 penetrates into the groove 70 formed on the rear face of the ring 36 under the action of the spring 144 and puts back in place the prolonging sheath 135, as shown on FIG. 4A. The annular position of the ring 36 bearing the interchangeable member 38 with respect to the various elements constituting the tool 100 is therefore known.

Figure 4A:
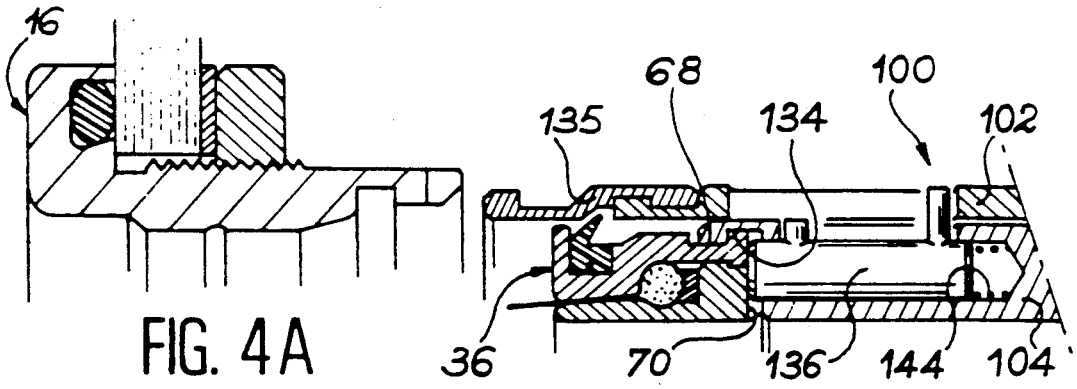
FIGS. 4A to 4D are longitudinal sectional views representing the successive phases for the mounting of the supporting ring of the sealed fixing device with the aid of the tool of FIG. 3, and FIGS. 5A to 5C are longitudinal sectional views representing the various stages for mounting the safety ring of the sealed fixing device with the aid of the tool of FIG. 3.
Figure 4B:
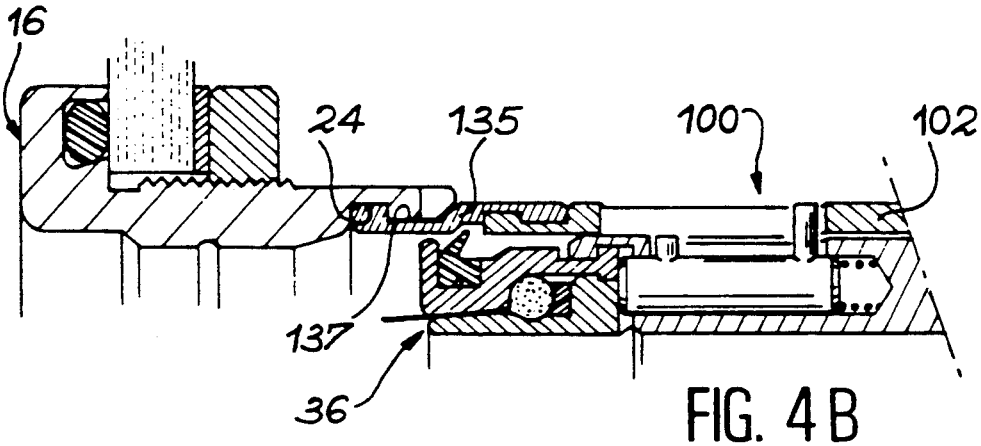

As shown on FIG. 4B, the tool 100 bearing the supporting ring 36 is then secured to the cell flange 16 via the cooperation of the sections 24 and 137 of the bayonet link system provided between the prolonging sheath 135 and the cell flange 16. Given the fact that the ring 36 is positioned angularly to the inside of the sheath 102, an angular positioning of this ring inside the cell flange 16 is thus ensured.

Then the slug 124 is retracted by acting on the operating handle 130 (FIG. 3) so as to separate the sleeve 110 from the sheath 102. Then with the aid of the levers 120, rotation of the sleeve 110 is controlled in the direction corresponding to the movement of this sleeve and piston 104 towards the front. As a result, the supporting ring 36 hooked to the piston 104 is pushed inside the cell flange 16 until the annular bulged section 64 of the ring 36 is in the additional throat 32. The travel of the piston 104 is accurately determined so that this positioning is fully ensured when the piston 104 occupies its extreme front position.

Figure 4C:
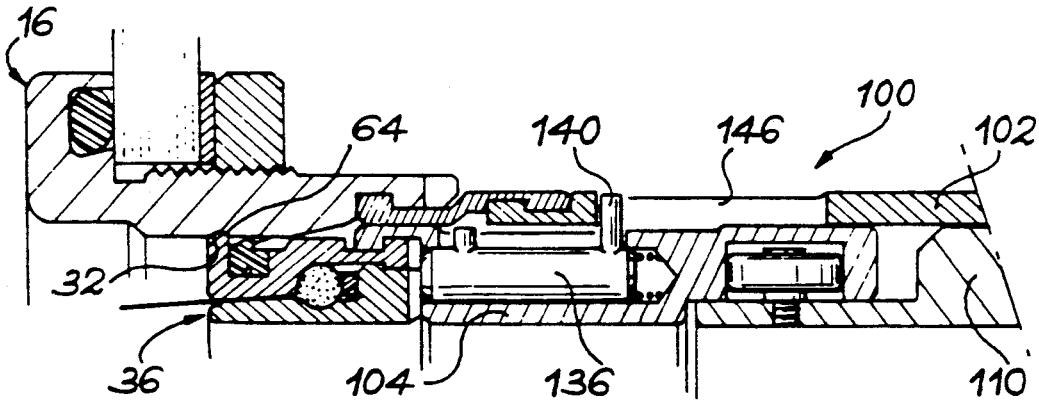

When this extreme front position of the piston 104 is attained, the indexing part 136 borne by this piston is effaced towards the rear on account of the support of the radial rod 140 against the front extremity of the elongated hole 146, as shown on FIG. 4C. Accordingly, it is then possible to withdraw the tool by rotating the sheath 102, the sleeve 110 and the piston 104 with respect to the cell flange 16 and the supporting ring 36 then mounted in this cell flange. This result may easily be obtained by acting on the handles 120. In fact, when the sleeve 110 and the piston 104 reach their extreme front positions, the slug 124 penetrates into a second hole (not shown), similar to the hole 126, formed in the sheath 102.

Figure 4D:
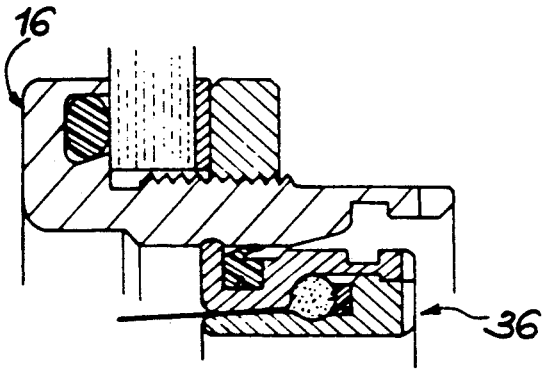

The supporting ring 36 is then mounted in the cell flange 16 as shown on FIG. 4D so that its axial and angular positions are known with accuracy.

Figure 5A:
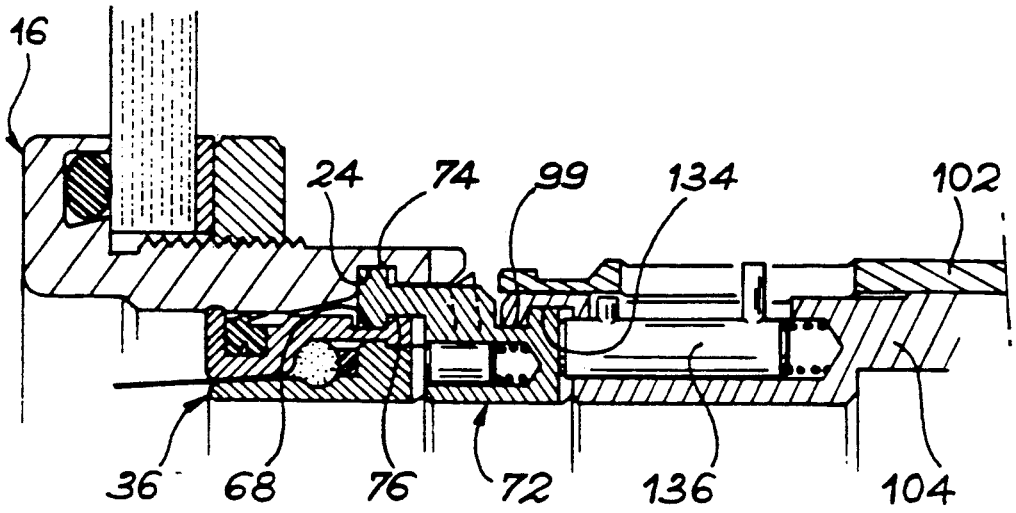
Figure 5B:
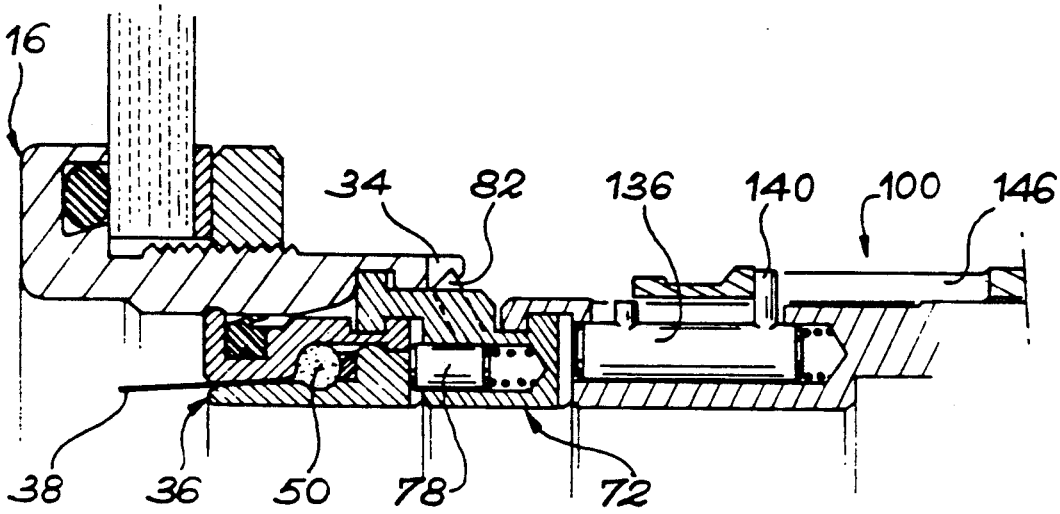
Figure 5C:
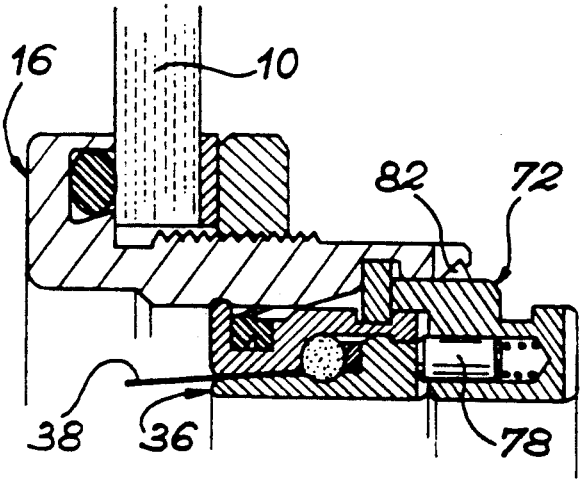

There now follows a description of the mounting of the safety ring 72 with reference to FIGS. 5A to 5C.

In order to embody this mounting, the prolonging sheath 135 is dismantled from the sheath 102 and the sleeve 110 and the piston 104 are placed in an intermediate position with respect to the sheath 102. This position may be determined by a hole (not shown) similar to the hole 126 and penetrated by the slug 124. The safety ring 72 is then fixed to the front extremity of the piston by the copperation of the sections 99 and 134 of the corresponding bayonet link system.

When this fixing has been carried out, the indexing part 136 penetrates into the recessed section 92 formed on the rear face of the ring 72 (FIG. 2A), which has the effect of causing the lever 88 to tilt and accordingly bringing the snug 78 and the lever 82 at their inactive positions into the position shown on FIG. 2B.

The safety ring 72 is then simultaneously secured to the cell flange 16 and to the supporting ring 36 via the cooperation of the sections 24 and 74 of the bayonet link system formed between the flange 16 and the ring 72 and by the cooperation of the sections 68 and 76 formed between the rings 36 and 72. The corresponding situation is shown on FIG. 5A.

Then the rotation locking of the safety ring 72 on the cell flange 16 and on the supporting ring 36 is triggered by controlling a movement of the piston 104 to its extreme front position with respect to the sheath 102. In order to do this, the handles 120 of the sleeve 110 are again activated after having unlocked the sleeve of the sheath 102 by means of the latch 130. In these circumstances, the indexing part 136 is brought into its rear inactive position by the radial rod 140 cooperating with the front extremity of the aperture 146, as shown on FIG. 5B. As a result, the levers 88 and 82 and the snug 78 reassume their active positions shown on FIG. 2A. By penetrating into the groove 34, the lever 82 immobilizes the safety ring 72 rotating inside the cell flange 16. At the same time, the snug 78 immobilizes the supporting ring 36 rotating with respect to the safety ring 72. Thus, any relative rotation between the rings 36 and 72 and the flange 16 is prevented and the angular positioning of the supporting ring 36 inside the cell flange is accurately ensured without there being any risk of accidental disconnection.

The tool 100 may then be disconnected from the safety ring 72, as shown on FIG. 5C.

The sealed fixing device of the invention thus makes it possible to eliminate any risk of accidental pulling away of an interchangeable member, whilst ensuring the placing of this member without it being necessary to exert significant forces and by guaranteeing its angular positioning if this is required.

In the case where the device is intended to replace an existing fixing device bearing a worn member 38, first of all the safety ring 72 is dismantled with the aid of the tool 100 not equipped with the prolonging sheath 135 by carrying out in reverse order the operations described above with reference to FIGS. 5A to 5C. Then the supporting ring 32 bearing the new member 38 is placed by automatically expelling inside the cell the supporting ring bearing the worn member at the time of the axial introduction of the new supporting ring described with reference to FIG. 4C. The bulged section 64 of the worn ring then cleans the surface of the cylindrical section 28 inside the cell. Finally, a safety ring may be the same ring mentioned previously or a new ring is placed.

Of course, the invention is not merely limited to the embodiment described above by way of example, but covers all possible variants. In particular, the members ensuring blocking of the safety ring rotating with respect to both the supporting ring and the cell flange may assume shapes differing from those described earlier. The same applies for the means able to control the effacing of these blocking members.

Furthermore, the fixing device of the invention is compatible with containment cells whose wall is externally doubled by means of a biological protection system.

Finally, it is important to note that the supporting ring described above may, in certain applications, be replaced by a double or triple ring, for example. In particular, a double ring makes it possible to fix the two casings of a twin-casing interchangeable member between a single external ring bearing two lip seals similar to the joint 66 and two internal rings respectively nested via the front and the rear of the external ring, a passage traversing the latter and opening between the two lip seals opposite a passage formed in the cell flange making it possible to subsequently ventilate and control the inter-casing space. A triple ring, in reality constituted by two double rings mounted end-to-end and each bearing a twin-casing member, make it possible, as well as allowing for inter-casing ventilation, to place in an atmosphere the volume situated between the two members by means of an additional passage formed in the cell ring.

What is claimed is:

1. Device for the sealed fixing of an interchangeable member inside a flange having a bayonet link and mounted on a wall of a containment cell, said device comprising:

a supporting ring fittable in the flange and having means for bearing the interchangeable member, said supporting ring including a bayonet link;

a safety ring having bayonet links engageable with both the bayonet link of said supporting ring and the bayonet link of the flange for fixing the safety ring to the flange and to said supporting ring when the supporting ring is fitted in the flange; and means for immobilizing said safety ring against rotation with respect to the flange and said supporting ring when said safety ring is fixed to said flange and said supporting ring via said bayonet links.

2. Device according to claim 1, wherein the means to immobilize rotation of the safety ring include at least two blocking members mounted in the safety ring and movable between an active position and an inactive position, and at least two grooves respectively formed in the flange and in the supporting ring and respectively situated opposite each of said blocking members when the safety ring is fixed by said bayonet links, wherein said blocking members penetrate into the grooves when they are in the active position.

3. Device according to claim 2, including elastic means mounted in the safety ring for normally stressing the blocking members towards their active position.

4. Device according to claim 1, wherein a first of said blocking members is a sliding snug which projects beyond a front face of the safety ring in the active position and into a radial groove formed on a rear face of the supporting ring, and the second blocking member is a tilting lever which projects beyond a peripheral edge of the safety ring and, in the active position, penetrates inside a radial groove formed in a rear extremity of the flange.

5. Device according to claim 2, wherein the safety ring bears a member for controlling the blocking members, said member being accessible from a rear face of the safety ring and whose activation has the effect of bringing the blocking members into the inactive position.

6. Device according to claim 1, wherein the supporting ring comprises a bulged annular section able to penetrate into an additional holding throat formed inside the flange when the supporting ring is fitted in the flange.

7. Device according to claim 1, wherein the supporting ring includes two rigid parts nestable into each other and means for clipping the rigid parts to one another so as to compress in an annular recess delimited between the two parts an extremity flange of the interchangeable member, including a compressible joint in the annular recess for compensating for dimensional variations of the flange.

8. Device according to claim 7, wherein the two rigid parts have two opposing truncated surfaces which connect said annular recess to a front face of the supporting ring and between which is compressed a flexible wall of the interchangeable member, said truncated surfaces each having a different conicity so that the compression of the flexible wall is greater close to the front face of the supporting ring.

9. Device according to claim 7, wherein the rigid parts include an internal ring around which a throat with an arc of a circle section is formed for receiving the extremity flange of the interchangeable member, and an external ring in which a shoulder with an arc of a circle section is formed and orientated towards a rear face of the supporting ring and on which said extremity flange is supported.

* * * * *